US005735343A

United States Patent [19]

Kajikawa et al.

[11] Patent Number: 5,735,343

[45] Date of Patent: Apr. 7, 1998

[54] REFRIGERANT EVAPORATOR

[75] Inventors: Yoshiharu Kajikawa, Hekinan; Masahiro Shimoya; Eiichi Torigoe, both of Kariya, all of Japan

[73] Assignee: Denso Corporation, Kariya, Japan

[21] Appl. No.: 767,951

[22] Filed: Dec. 17, 1996

[30] Foreign Application Priority Data

Dec. 20, 1995 [JP] Japan ..... 7-332093

[51] Int. Cl.[6] ..... F28D 1/03

[52] U.S. Cl. ..... 165/153; 165/146; 165/176

[58] Field of Search ..... 165/153, 176, 165/144, 145, 146; 62/575

[56] References Cited

U.S. PATENT DOCUMENTS

| | | | |
|---|---|---|---|
| 4,653,572 | 3/1987 | Bennett et al. | 165/146 X |
| 5,099,913 | 3/1992 | Kadle | 165/153 X |
| 5,137,082 | 8/1992 | Shimoya et al. | 165/153 X |
| 5,417,280 | 5/1995 | Hayashi et al. | 165/153 |

FOREIGN PATENT DOCUMENTS

| | | | |
|---|---|---|---|
| 175769 | 11/1988 | Japan | 165/146 |
| 171591 | 7/1990 | Japan | 165/153 |
| 140795 | 6/1991 | Japan | 165/153 |
| 60387 | 2/1992 | Japan | 165/146 |
| 7-12778 | 3/1995 | Japan . | |

*Primary Examiner*—Leonard R. Leo

*Attorney, Agent, or Firm*—Harness, Dickey & Pierce, PLC

[57] ABSTRACT

A core plates forming a core body includes an upstream refrigerant passage for communicating an upper and a lower tank disposed at a downstream side and a downstream refrigerant passage for communicating an upper and a lower tanks disposed at an upstream side with respect to the air flow direction. Ribs are formed on an inner surface of the upstream refrigerant passage to agitate the refrigerant, and inner fins are provided on the inner surface of the downstream refrigerant passage which receives a refrigerant after passing through each the upstream refrigerant passage of each the core body.

7 Claims, 5 Drawing Sheets

REFRIGERANT EVAPORATOR

CROSS-REFERENCE TO RELATED APPLICATION

This application is related to and claims priority from Japanese Patent Application No. Hei. 7-332093, filed on December 20, the contents of which are hereby incorporated by reference.

BACKGROUND OF THE INVENTION

1. Field of the Invention

The present invention relates to a refrigerant evaporator used for a cooling apparatus, and more particularly, to a refrigerant evaporator which has a high heat exchange efficiency and can be manufactured simply.

2. Description of Related Art

FIG. 5 shows a conventional laminated type evaporator proposed in JP-U-7-12778 as an example. In this type refrigerant evaporator, a plurality of core bodies 1 are laminated with each other in parallel in a direction perpendicular to the air flow shown by an arrow. Each core body 1 is formed by abutting outer peripheries 51 of a pair of elongated core plates 5 shown in FIG. 6 to form inner spaces therebetween. That is, the core plate 5 is shallowly recessed by pressing, while remaining the outer periphery 51 and a center partition portion 52, so that the core plate 5 has a shallow cup shape, and a deeper circular recessed portions 53, 54, 55 and 56 are formed in a left and a right positions of an upper end and a lower end of the core plate 5 (at four corners). By means of the core plate 5 disposed in a heat exchanger, the recessed portions 53, 54, 55 and 56 are circularly stamped or are closed without being stamped.

When a pair of the core plates 5 are abutted to each other, the inner spaces form sealed flat tubes 4 (shown in FIG. 5) separated from each other at the left side and the right side by the partition portion 52, the recessed portions 53, 54, 55 and 56 located at four corners of the core plate 5 form circular tank portions projected from the two side surfaces of each core body 1. The projected ends of the tank portions of each the core body 1 are put together and connected, so that tanks 2A, 2B, 3A and 3B which are extended in parallel in the horizontal direction (shown in FIG. 5) are respectively formed in the upper end and the lower end of the laminated type refrigerant evaporator. As described later, the upper tanks 2A and 2B are closed at the center position.

The upper and lower tanks 2A and 3A at an upstream air side communicate with the upper and lower tanks 2B and 3B at a downstream air side, respectively, through each refrigerant passages 13A and 13B (shown in FIG. 6) within the tube 4 separated by the partition portion 52. A plurality of inclined ribs 131 and 132 are integrally formed with the refrigerant passages 13A and 13B and are projected from the inner surface of the refrigerant passages 13A and 13B. When a pair of the core plates are abutted, the opposite ribs 131 and 132 are crossed with each other so that refrigerant flowing through the refrigerant passages 13A and 13B is agitated.

As shown in FIG. 5, the spaces between each pair of adjacent tubes 4 are used for air flow passages P, and corrugated fins are disposed in the air flow passages P. As shown by the arrow in FIG. 5, air flows from the upstream tanks 2A and 3A to the downstream tanks 2B and 3B.

The left and right ends of the refrigerant evaporator are respectively closed by an end plate 6 (FIG. 5 only shows a right end side), and a passage 61 for communicating the upper tanks 2A with 2B is formed in the end plate 6 of the right end side of the refrigerant evaporator. On the other hand, in the end plate 6 of the left end side of the refrigerant evaporator, a refrigerant supply pipe 71 is connected to the upper tank 2B at the downstream air side, a refrigerant discharge pipe 72 is connected to the upper tank 2A at the upstream air side.

FIG. 7 shows a refrigerant flow direction. Refrigerant supplied from the refrigerant supply pipe 71 into the left section of the upper tank 2B at the downstream air side flows downward in this part of tubes to the lower tank 3B at the downstream air side, and further flows from the left section to the right section of the lower tank 3B. Then, the refrigerant changes its flowing direction to the upward direction and flows through the right section of the upper tank 2B, the passage 61 of the end plate 6, the right section of the upper tank 2A at the upstream air side. Further, the refrigerant flows downward in this part of tubes through the right section of the lower tank 3A at the upstream air side to the left section of the lower tank 3A at the upstream air side. Then, the refrigerant flows upward in this part of tubes to the left section of the upper tank 2A and flows outside through the refrigerant discharge pipe 72.

Thus, refrigerant flows through each of the tubes between the upper tank 2A and the lower tank 3A at the upstream air side after flowing through each of the tubes between upper tank 2B and lower tank 3B at the downstream side, so that air passing through the air flow passage P is cooled.

As described above, the crossed ribs are formed on the inner tube to effectively cool the outside air flowing therethrough, and refrigerant flowing through the tubes is agitated by the ribs so that the heat transmitting performance is improved.

Further, to improve the heat transmitting performance, inner fins or the like are located so as to increase the heat transmitting area. However, because the inner fins or the like cannot be integrally formed with the inner wall of the tubes, there is a problem in that the number of steps for manufacturing and assembling the refrigerant evaporator is greatly increased.

SUMMARY OF THE INVENTION

In view of the foregoing problems, it is an object of the present invention to provide a refrigerant evaporator which can perform an effective cooling while an increase in the number of steps for manufacturing and assembling the refrigerant evaporator is suppressed.

According to the present invention, a part of an inner wall forming a downstream refrigerant passage are projected to the refrigerant passage side so as to agitate the refrigerant flowing therethrough, and heat transmitting area increasing means which is separately formed from an upstream refrigerant passage are thermally connected to the inner surface forming the upstream refrigerant passage.

That is, because refrigerant flowing through the downstream refrigerant passage has a lower refrigerant dryness, the heat transmitting performance of refrigerant can be sufficiently improved by the refrigerant agitating means such as ribs. On the other hand, refrigerant flowing through the upstream refrigerant passage has a higher refrigerant dryness, however, the heat transmitting performance of refrigerant can be sufficiently improved in this part by the heat transmitting area increasing means such as inner fins. Further, because the inner fins are provided only in the upstream refrigerant passage, the number of the manufacturing and assembling steps can be decreased as small as possible.

According to the present invention, the refrigerant agitating means and the heat transmitting area increasing means may be used for a laminated type refrigerant evaporator in which refrigerant flows through the upstream refrigerant passage after passing through the downstream refrigerant passage.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention will be described hereinafter with reference to the accompanying drawings.

A first embodiment of the present invention will be described.

Figure 1:
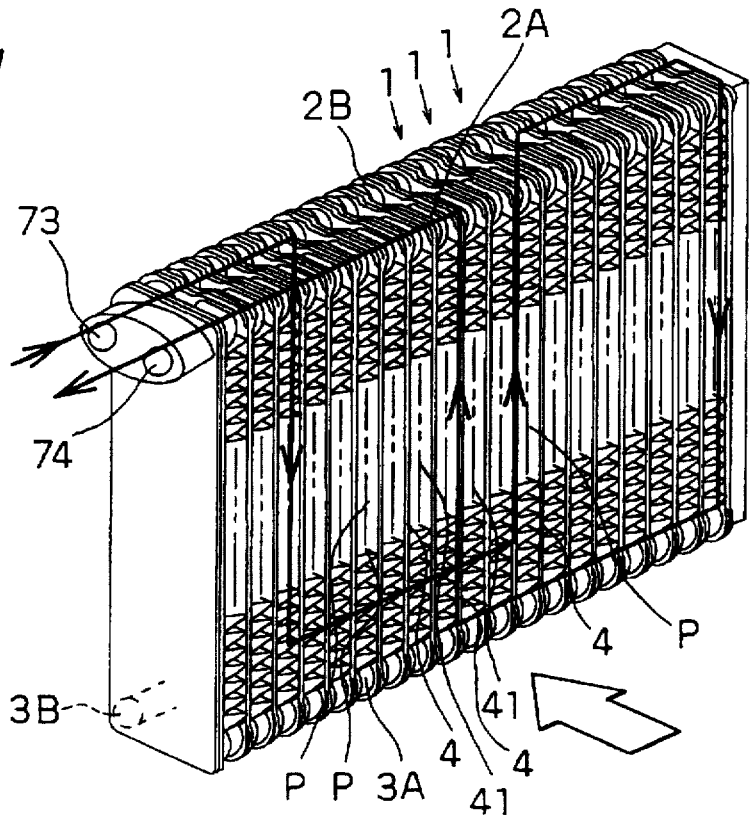
FIG. 1 is a perspective view showing a refrigerant evaporator according to a first embodiment of the present invention.

FIG. 1 shows a shape of a refrigerant evaporator of the present invention, a basic structure is similar to that of the above described conventional refrigerant evaporator.

That is, the refrigerant evaporator has a plurality of core bodies (tubes) laminated with each other in parallel in a direction perpendicular to the air flow shown by an arrow. Upper tanks 2A and 2B and lower tanks 3A and 3B are respectively formed at an upstream air side and a downstream air side of the laminated core bodies, and corrugated fins 41 are disposed in an airflow passage P between each pair of adjacent tubes 4 connecting the upper tanks 2A and 2B and the lower thanks 3A and 3B. As shown by the arrow in FIG. 1, air flows from the upper tank 2A and the lower tank 3A at the upstream air side to the upper tank 2B and the lower tank 3B at the downstream air side.

Refrigerant supplied from the refrigerant inlet 73 into the left section of the upper tank 2B flows the left section of the lower tank 3B, the right section of the lower tank 3B, the right section of the upper tank 2B, the right section of the upper tank 2A, the right section of the lower tank 3A, the left section of the lower tank 3A and the left section of the upper tank 2A in that order and is discharged from the refrigerant outlet 74 to the outside. As described above, refrigerant flows in each of the tubes 4 between upper tank 2A and the lower tank 3A at the upstream air side after flowing through each of the tubes 4 between the upper tank 2B and the lower tank 3B at the downstream air side.

Figure 2:
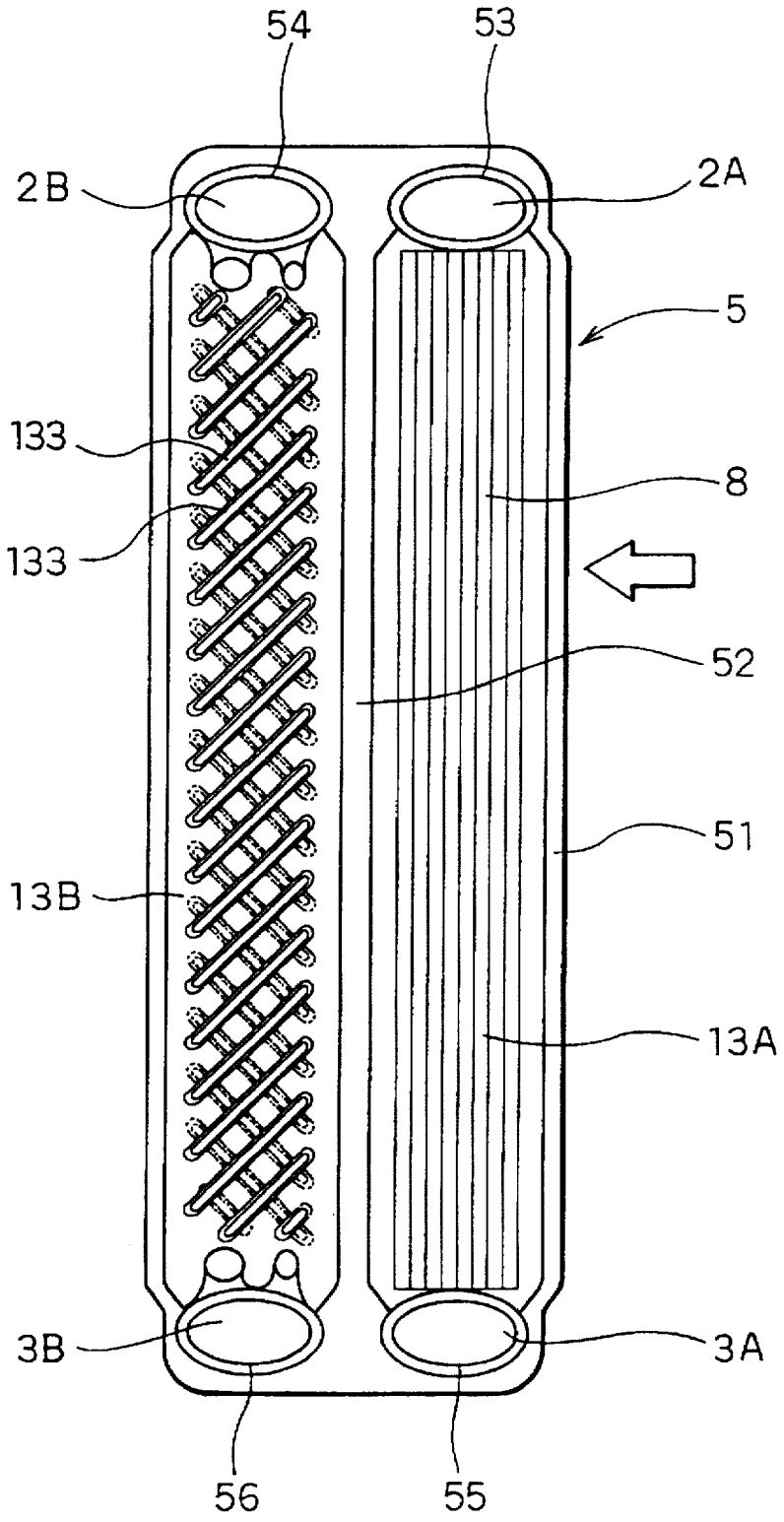
FIG. 2 is a front view showing an inner surface of a core plate according to the first embodiment of the present invention.

FIG. 2 shows an inside of a core plate 5 forming the core bodies 1 of the evaporator. The core plate 5 is entirely formed in nearly a shallow rectangular cup shape. Recessed portions 53, 54, 55 and 56 are formed in a left and a right positions of an upper end and a lower end of the core plate 5 (at four corners), and elliptic openings are formed in these recessed portions 53, 54, 55 and 56. When each pair of the same core plates are abutted on the outer periphery 51 so as to form the core bodies 1, the recessed portions 53 and 55 respectively form the upper tank 2A and the lower tank 3A, located at the upstream air side, i.e., the rear side, and the recessed portion 54 and 56 respectively form the upper tank 2B and the lower tank 3B, located at the downstream air side i.e., the front side.

By means of partitioning with a partition portion 52, refrigerant passages 13A and 13B which respectively communicate the upper and lower recessed portions 53 and 55 with the upper and lower recessed portions 54 and 56 are defined. A plurality of ribs 133 which are slantingly extended are projected from the inner wall of the upstream refrigerant passage 13B. The ribs 133 at one side of the core plate 5 are crossed to that of the abutted opposite core plate 5 (shown by chain line in FIG. 2), refrigerant flowing through the upstream passage 13B is agitated by the crossed ribs 133. Further, a plurality of inner fins 8 which are extended in parallel in the longitudinal direction (vertical direction in FIG. 2) are formed on the inner wall of the downstream refrigerant passage 13A.

Figure 3:
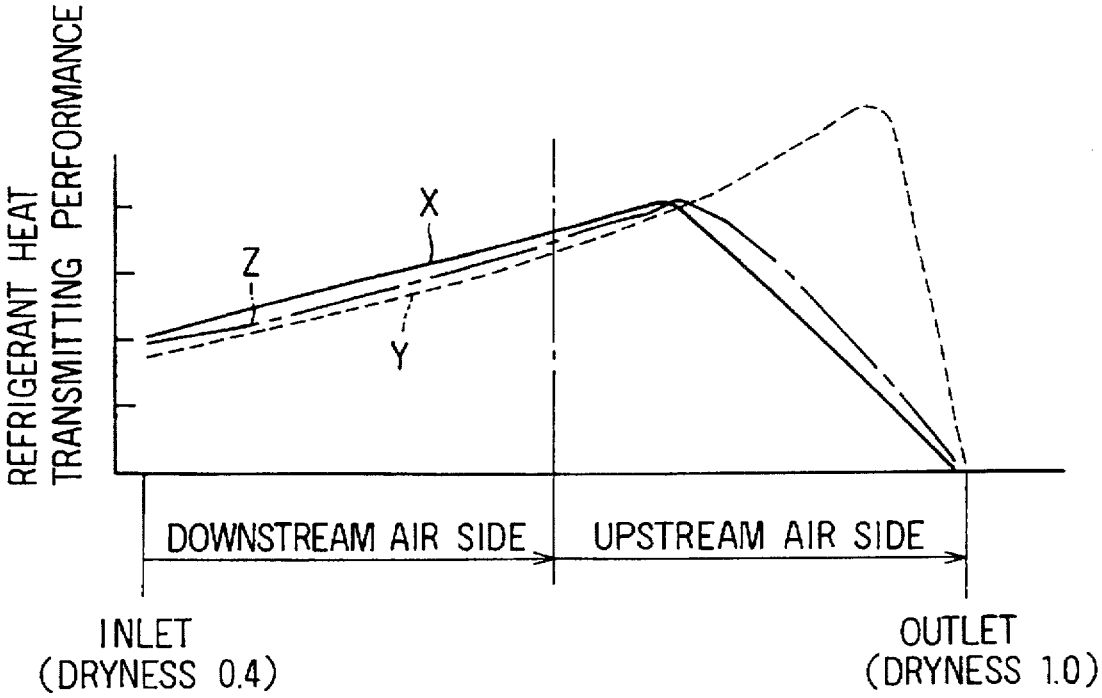
FIG. 3 is a graph showing a variation of a heat transmitting performance of refrigerant according to the first embodiment of the present invention.

A heat transmitting performance of refrigerant flowing through the refrigerant evaporate having the above described structure is shown in FIG. 3. In FIG. 3, the line X shows a variation of the heat transmitting performance with the ribs 133, the line Y shows a variation of the heat transmitting performance with the inner fins 8. As shown in FIG. 3, in the upstream refrigerant passage 13B in which a vaporous refrigerant having a low dryness flows, the heat transmitting performance does not variation so much even when the ribs 133 are used or the inner fins 8 are used. When the dryness of refrigerant is increased so that the flowing velocity of the refrigerant becomes faster, both refrigerant heat transmitting performances of the cases using either one of the ribs 133 and the inner fins 8 are gradually improved to the same degrees.

When the refrigerant flows in the downstream refrigerant passage 13A so that the dryness of the refrigerant is further increased to a certain value, the heat transmitting performance with the ribs 133 is rapidly deteriorated, however, the heat transmitting performance with the inner fins 8 is further improved and the increase is continued almost up to the refrigerant outlet.

That is, in the region where a dryness of refrigerant is low, the heat transmitting performances with either of the refrigerant agitation effect of the ribs 133 and the effect of increase in the heat transmitting area of refrigerant of the inner fins 8 are improved to the same degrees. However, when the dryness of refrigerant becomes larger, the improvement of the heat transmitting performance of refrigerant with the agitation effect of the ribs 133 reaches the upper limit, however, the heat transmitting performance of refrigerant with the increase in the heat transmitting area by means of the inner fins 8 is further improved even after the dryness of refrigerant becomes large greatly. Even if a little liquid drop is adhered to the surface of the inner fins 8, the heat transmitting performance is improved, so that the above described results can be obtained.

In this embodiment, ribs 133 which can be easily and simultaneously formed by pressing or the like when the core plate 5 is manufactured are disposed in the upstream refrigerant passage 13B having a low refrigerant dryness so as to improve the refrigerant heat transmitting performance. On the other hand, the inner fins 8 are disposed in the downstream refrigerant passage 13A having a high refrigerant dryness so as to improve the refrigerant heat transmitting performance. Thus, a high heat exchange efficiency (cooling air) can be obtained in the entire refrigerant passages. Further, because the inner fins 8 are disposed only in the downstream refrigerant passage, the number of the manufacturing and assembling steps is decreased.

It is not always necessary that the inner fins 8 are disposed in the entire tubes 4. The inner fins 8 may be disposed in a part of tubes adjacent to the refrigerant outlet side in which the heat transmitting performance cannot be improved by the ribs 133.

A second embodiment of the present invention will be described.

Figure 4:
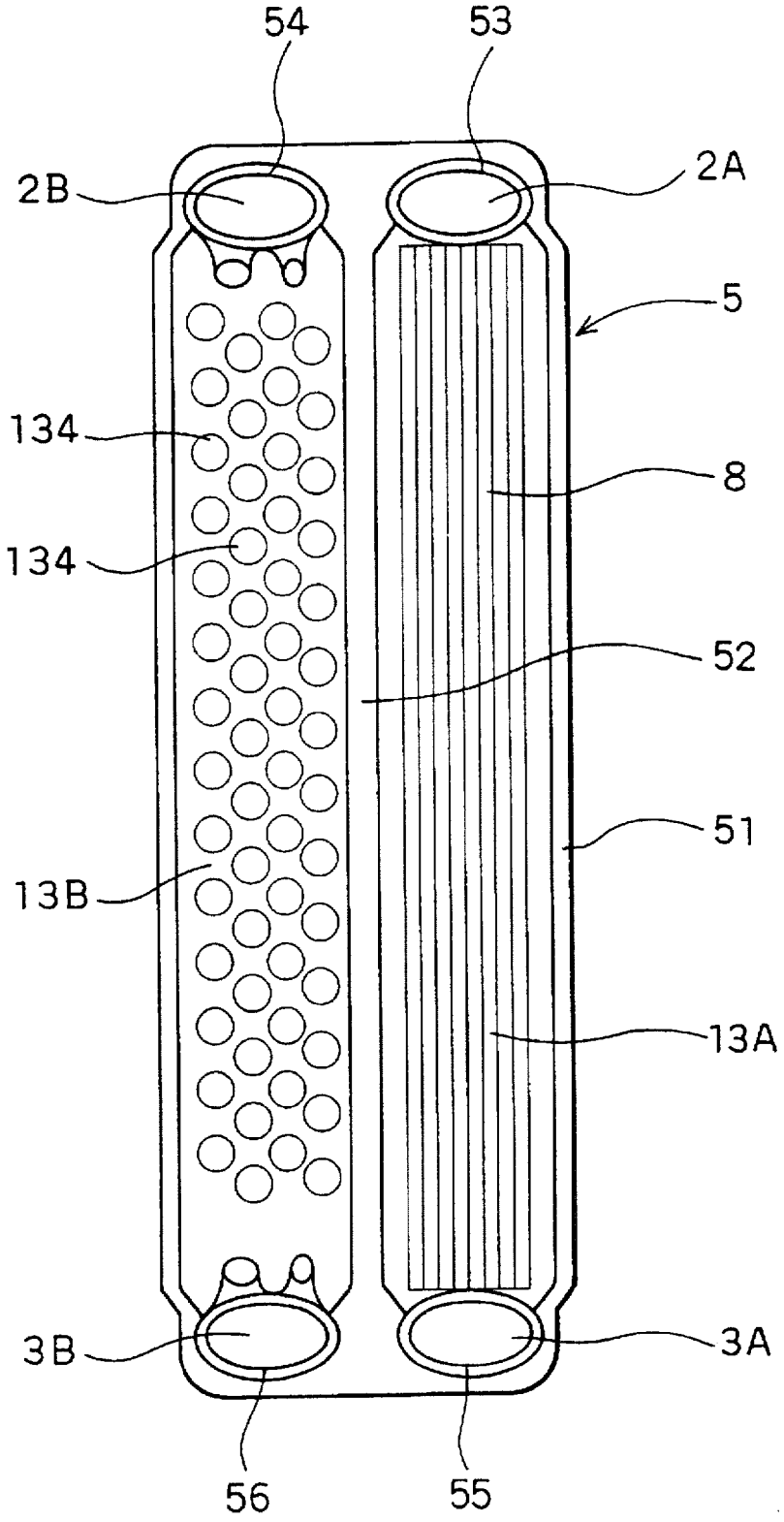
FIG. 4 is a front view showing an inner surface of a core plate according to a second embodiment of the present invention.
Figure 5:
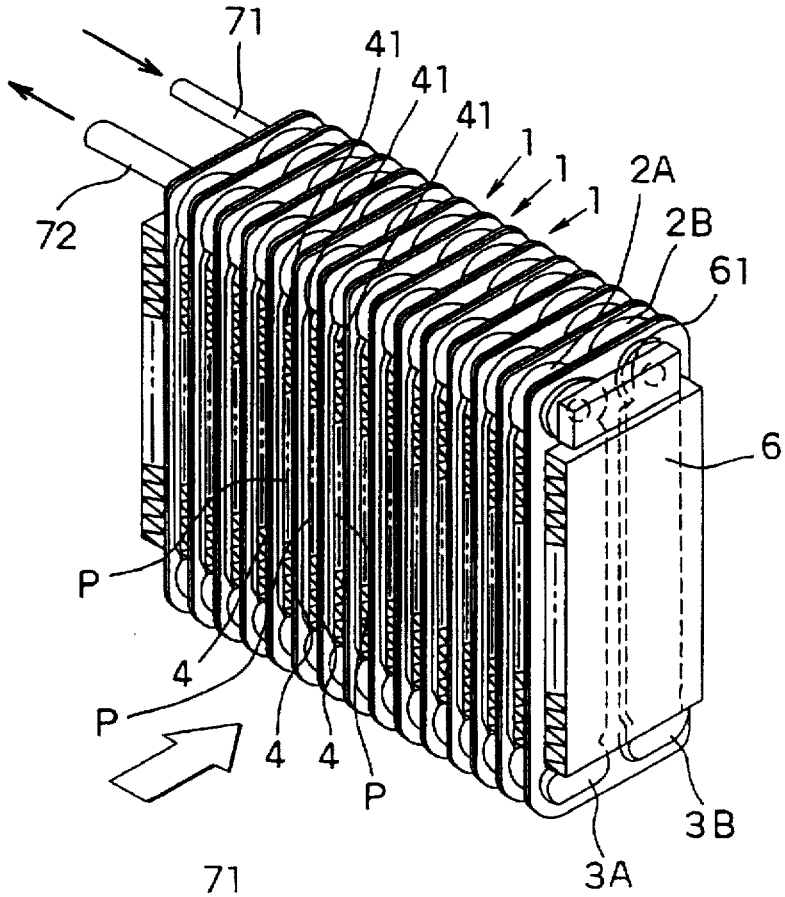
FIG. 5 PRIOR ART
FIG. 5 is a perspective view showing a conventional refrigerant evaporator.
Figure 7:
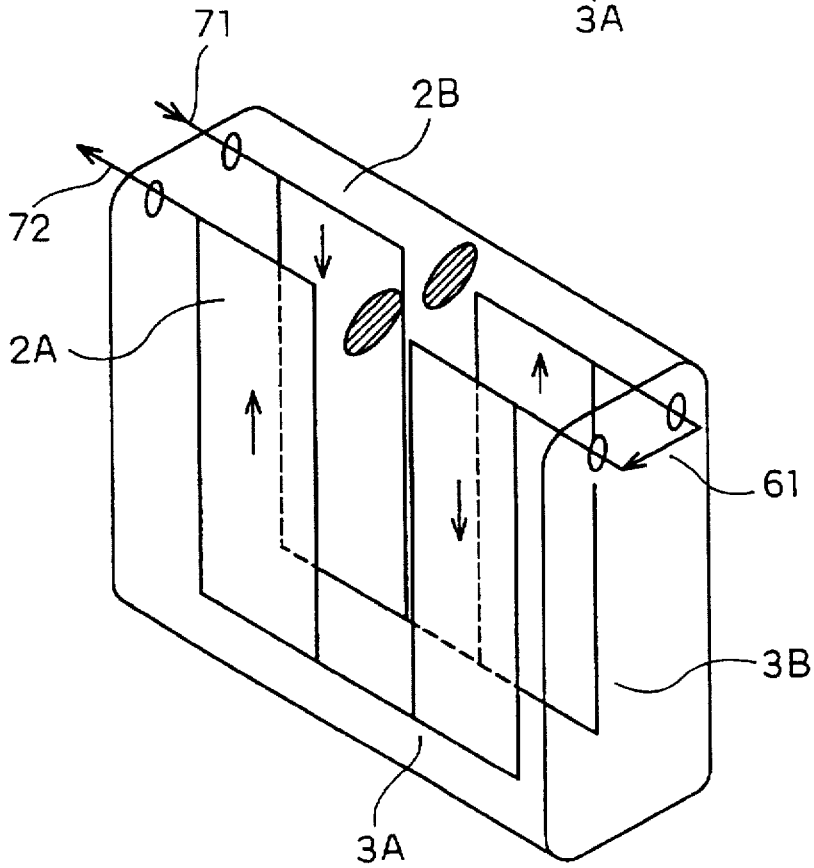
FIG. 7 PRIOR ART
FIG. 7 is a diagrammatic view showing the refrigerant circulating route in the conventional refrigerant evaporator.
Figure 6:
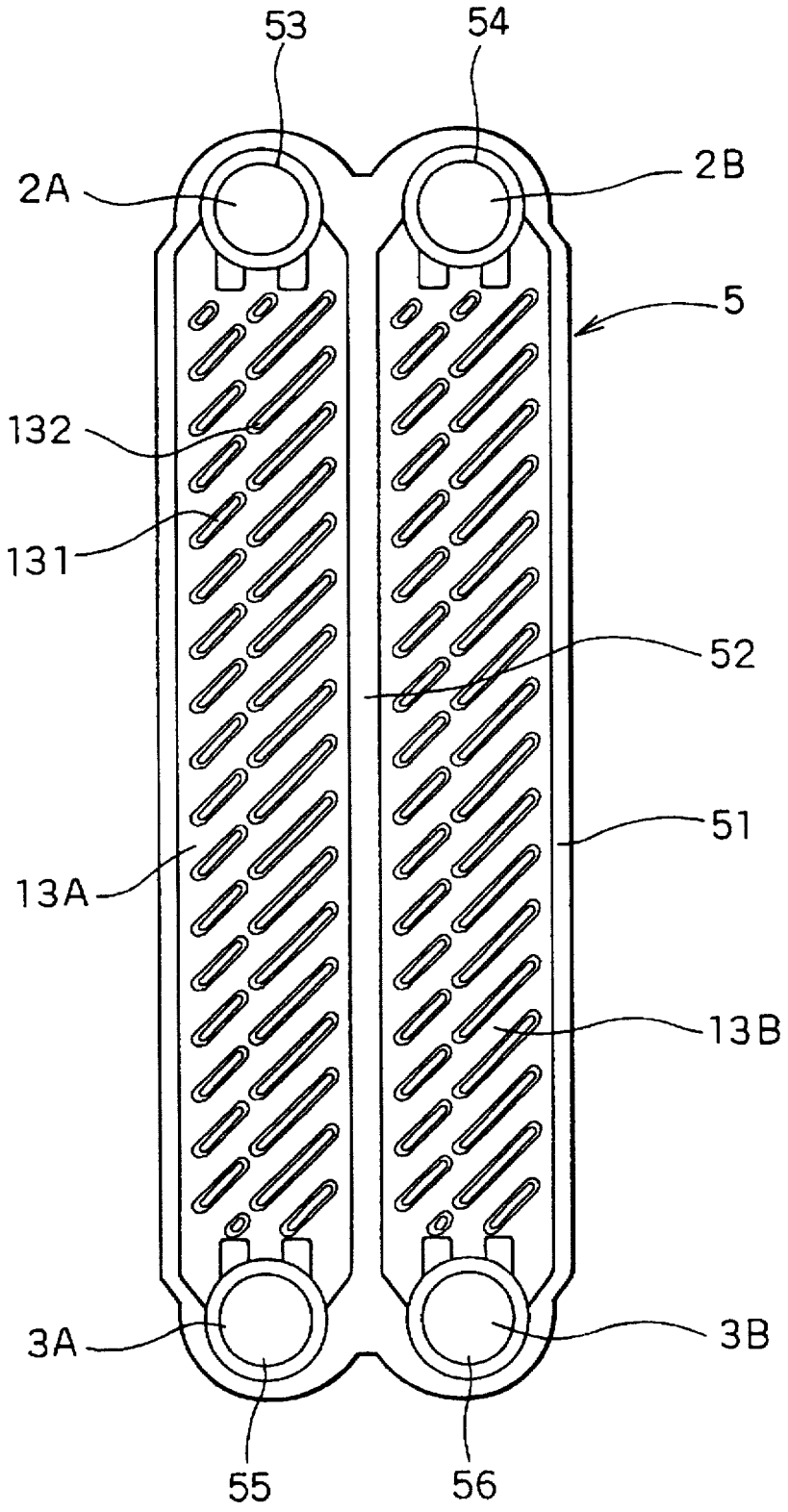
FIG. 6 PRIOR ART
FIG. 6 is a front view showing an inner surface of a core plate according to the conventional refrigerant evaporator.

As shown in FIG. 4, instead of the ribs 133 of the first embodiment, a plurality of circular dimples 134 are projected from the inside surface of the upstream refrigerant passage 13B in the tubes 4, so that the heat transmitting performance with agitating refrigerant can be improved. When the dimples 134 are formed, the variation of the heat transmitting performance is shown by the line Z in FIG. 3. As shown in FIG. 3, the variation of heat transmitting performance is nearly similar to that in the case where the ribs 133 are disposed.

In the above described embodiments, the present invention is used for the four tanks type refrigerant evaporator. However, the present invention may be applied to a conventional two tanks type refrigerant evaporator in which the refrigerant makes a U-turn.

The present invention having been described hereinabove should not be limited to the above-described embodiments and modifications thereof but may be implemented in other ways without departing from the scope and spirit of the present invention.

What is claimed is:

1. A refrigerant evaporator for evaporating refrigerant by heat exchanging with outside air flowing therethrough in an air flow direction, comprising:

means for forming a refrigerant passage by an inner wall thereof said refrigerant passage including an upstream refrigerant passage, into which said refrigerant flows, disposed at a downstream side in said air flow direction, and a downstream refrigerant passage, from which said refrigerant is discharged, disposed at an upstream side in said air flow direction and connected to said upstream refrigerant passage;

refrigerant agitating means for agitating said refrigerant therethrough, said refrigerant agitating means being formed throughout said upstream refrigerant passage by projecting inwardly a part of said wall forming said upstream refrigerant passage; and heat transmitting area increasing means for increasing a heat transmitting area, said heat transmitting means being separately formed from said inner wall and thermally connected to a surface throughout said inner wall forming said downstream refrigerant passage.

2. A refrigerant evaporator according to claim 1, wherein, said means for forming said refrigerant passage includes a plurality of flat cup shaped core bodies laminated with each other, each of which is formed by laminating a pair of core plates having a first upstream tank portion and a first downstream tank portion at an end thereof and a second upstream tank portion and a second downstream tank portion at the other end thereof, said first and second upstream tank portions being disposed at the downstream side in said air flow direction and said first and second downstream tank portions being disposed at the upstream side in said air flow direction, and each of said first upstream tank portions, said first downstream tank portions, said second upstream tank portions, and said second downstream tank portions of said core bodies communicate with each other.

3. A refrigerant evaporator according to claim 2, wherein, an air passage is formed between each pair of adjacent core bodies.

4. A refrigerant evaporator according to claim 3, wherein, each of said core bodies forms therein said downstream refrigerant passage communicating said first downstream tank portion with said second downstream tank portion and said upstream refrigerant passage communicating said first upstream tank portion and said second upstream tank portion.

5. A refrigerant evaporator according to claim 1, wherein, said refrigerant agitating means includes a plurality of cross ribs projected from said inner wall for forming said upstream refrigerant passage.

6. A refrigerant evaporator according to claim 1, wherein, said refrigerant agitating means includes a plurality of circular dimples projected from said inner wall for forming said upstream refrigerant passage.

7. A refrigerant evaporator according to claim 1, wherein, said heat transmitting area increasing means includes a plurality of inner fins provided on said inner wall of said downstream refrigerant passage.

* * * * *